US008742239B1

(12) United States Patent
Storck

(10) Patent No.: US 8,742,239 B1
(45) Date of Patent: Jun. 3, 2014

(54) EASY ACCESS FLEXIBLE CONTAINER AND PICK HOLDER FOR STRINGED MUSICAL INSTRUMENT PICKS

(71) Applicant: Kurt Storck, Farmington Hills, MI (US)

(72) Inventor: Kurt Storck, Farmington Hills, MI (US)

( * ) Notice: Subject to any disclaimer, the term of this patent is extended or adjusted under 35 U.S.C. 154(b) by 0 days.

(21) Appl. No.: 13/746,298

(22) Filed: Jan. 21, 2013

(51) Int. Cl.
*G10D 3/16* (2006.01)

(52) U.S. Cl.
USPC ..... 84/320

(58) Field of Classification Search
USPC ..... 84/320–322
See application file for complete search history.

(56) References Cited

U.S. PATENT DOCUMENTS

2006/0096440 A1* 5/2006 Weathersby ..... 84/322
2011/0284405 A1* 11/2011 Mitten et al. ..... 206/268

* cited by examiner

*Primary Examiner* — Kimberly Lockett
(74) *Attorney, Agent, or Firm* — Thomas Heed

(57) ABSTRACT

The present invention is a flexible container and pick holder for a musical instrument. The flexible container and pick holder has a plurality of thin slots on its face, in which can be placed musical instrument picks. The thin slots have a raised lip or ridge that keeps the pick at a small acute angle with respect to the face of the flexible container and pick holder. The material of the face of the flexible container and pick holder is such that the musician's thumb can easily swipe or move a guitar pick across it. The present invention can be positioned so that the musician can easily reach the face containing the picks using the thumb of the strumming hand.

1 Claim, 8 Drawing Sheets

EASY ACCESS FLEXIBLE CONTAINER AND PICK HOLDER FOR STRINGED MUSICAL INSTRUMENT PICKS

FIELD OF INVENTION

This invention relates to the field of musical instruments, specifically to article holders which attach to musical instruments and hold items such as picks (U.S. Classification 84/329).

BACKGROUND OF INVENTION

Musicians who play stringed instruments, in particular guitars, use picks, also called plectrums. A pick is a small piece of thin plastic, metal, stone, bone, or other thin, rigid material, used to strum the strings of an instrument. Picks are usually, roughly speaking, triangular or teardrop in shape. The material, thickness, geometry, and tip of the pick affect the sonic characteristics of the instrument. For example, a really stiff, thick pick will have a very different sound from a thin, softer pick. The angle, depth, and direction of motion of the pick striking the strings is called the attack. The attack is individualized for each musician. Some musicians have quite an aggressive attack, striking the strings with a substantial portion of the pick, while using a locked thumb, putting quite a bit of force on the pick.

During extended playing, such as concerts, recording sessions or practices, stringed instrument musicians often find a need to use a new pick, for a variety of reasons. After playing for a while, a musician's hands may become sweaty or moist, making it more likely that the musician will drop or mishandle the pick. While rapidly strumming, many musicians lose their grip on their pick, and drop the pick. Additionally, due to the thin, brittle nature of picks, they tend to break during prolonged play, especially when used with an aggressive attack. Lastly, with extended play, the point of the pick can be rubbed away due to string friction. As the pick loses its point, it changes sonic characteristic and the attack on the string. Relatively speaking, thin and medium thickness picks tend to crack or break more than thicker ones.

Ideally, when a musician needs a new pick during a session, a pick should be available to the strumming hand of the musician, with no time lag. If the musician must stop to grab a pick, it can affect the quality of the concert or recording. Additionally, it can disrupt the group with whom the musician is practicing. An ideal pick holder would allow the musician to get a new pick with a quick, reliable movement, without interrupting playing. The solution should allow the musician to get a new pick a number of times. In other words, the pick holder should have capacity for a plurality of picks, and it should offer a way of rapidly grasping a single new pick.

Currently, when a musician needs a new pick during a session, they have a limited number of options. First, they can stop playing and get a new pick. Second, they can use their nails, instead of the pick. Third, they can use a deformed or partially broken pick, until they have a reasonable chance to replace the pick. Fourth, they can use one of the existing solutions for a pick holder.

None of the current solutions in the prior art are ideal. Some musicians use small, clear plastic bags to hold picks. The musician will keep this bag nearby while playing. The problem with this solution is that the musician has to stop playing, pick up the bag, remove a pick, and resume playing.

Some musicians use pick-holder products that are designed to fit on the neck or headstock of the instrument near the tuning, such as the Wedgie Headstock Pick Holder. There are a substantial number of patents for pick holders mounted on or near the headstock, including U.S. Pat. Nos. 1,784,934; 5,127,300; and 6,639,136. The problem with all of these solution is that the picks are available to the wrong hand of the musician. In order to access a new pick, the musician still needs to cease strumming the instrument, reach to the headstock with his or her strumming hand, and then resume playing.

Some musicians use pick holders that offers access to a spring-loaded stack of picks. The prior art contains many patents disclosing various types of spring loaded pick holders, including U.S. Pat. Nos. 5,847,299, 7,626,103, and 7,629,522. These types of pick holders are sub-optimum for a couple of reasons. First, the pick holder will respond to picks differently, based on the surface texture, thickness, and material of the pick. Many musicians have a wide variety of picks, with the picks coming in variety of hardnesses, thicknesses, and surface finishes. A spring loaded solution would tend to jam-up with many of the picks that are textured in order to improve the musician's ability to hold them. Additionally, thicker picks would tend to be more difficult to remove. Lastly, due to the varying thicknesses of picks, the spring loaded holders that stack the picks, such as U.S. Pat. No. 5,847,299, would tend to dispense more than one pick when filled with thinner picks.

Some musicians use pick holders that retain the picks using some form of friction fit. The prior art contains many patents disclosing various types of pick holders that use friction fits to retain the pick, including, U.S. Pat. Nos. 5,299,485; 5,651,468; and 6,215,052. The problem with pick holders that use friction fits in order to retain the pick, is that the musician has to use two fingers to remove the pick. This means the musician's strumming hand must stop. Additionally, the amount of retention force for this type of pick-holder clearly depends on the thickness and surface finish of the pick, giving the musician variable retention force, which is sub-optimal. These types of pick holders make the musician prone to mishandling the pick, when attempting to remove one quickly.

Some musicians use pick holders that retain picks in a pocket, or pockets, sized to hold guitar picks. The prior art contains many patents disclosing various types of pick holders, pick slots, or both, including, U.S. Pat. Nos. 4,785,708; 5,905,217; 6,472,590; and 8,097,799. Just a raw pocket, roughly sized to fit a guitar pick, makes a poor pick holder. The pocket will fit some picks snuggly and other picks loosely. Some of the prior art tried to overcome this problems, such as Stephen Vaughan's U.S. Pat. No. 4,758,708. This patent uses slots within each pocket to create proper retention force. The problem with the Vaughan patent is that it requires two fingers to remove a pick, precisely because it provides positive retention force. The U.S. Pat. No. 8,097,799 also uses a retainer to forcibly hold the pick. The U.S. Pat. No. 6,472,590 is for a pick holder sewn into a flexible arm sleeve. The flexible arm sleeve creates a force fit of the pick, while the flexible sleeve is being worn. In essence, these three patents are using a force fit in a pocket, which creates the same problem discussed, above. Other pocket-based solutions, such as U.S. Pat. No. 5,905,217, offer just a single pick in a pocket or sleeve. Clearly, none of the prior art offers an ideal solution for a pick holder for a stringed instrument.

SUMMARY OF THE INVENTION

The present invention is a flexible container and pick holder for musical instrument picks. The present invention may take on a variety of shapes, for aesthetic purposes, such as cubic, rectangular, cylindrical, triangular, pyramidal, polygonal, or a combination. Profiles can range from thick to thin.

Regardless of the shape of the flexible container and pick holder, the invention has a plurality of surfaces with a front side oriented towards the strumming hand of the musician. The front face has a plurality of thin slots, capable of receiving a pick. Embroidery, plastic, or other material forms a lip or raised ridge around the edge of the thin slot. Additionally, the embroidery, plastic, or other material, reinforces the face material, keeping it from splitting. The thin slot is sized such that it fits standard-sized picks of various thicknesses and surface textures, such as one would use for a guitar, banjo, mandolin, or other plucked instrument. The lip or raised ridge is sized such that it allows the pick to form a small acute angle in relationship to the face of the flexible container and pick holder.

The material of the face of the flexible container and pick holder is, obviously, flexible, and allows the pick to slide on it. Suitable materials include, but are not limited to, leather, imitation leather, polyethylene, polypropylene, cotton, nylon, polyester, polyether, burlap, canvas, wool, satin, and silk. The musician can easily remove a pick from the container by sliding it out with the thumb of his or her strumming hand. The present invention comes with means for securing it to the strap, peg, or body of the instrument, including, but not limited to a plastic or metal clip, hook-and-loop fasteners, strings, and elastic loops. The present invention is sized such that it is unobtrusive, when secured to the musical instrument, strap, or peg of the instrument. By holding the pick at a small, acute angle with respect to the face, without using a friction fit, the present invention allows the musician to dispense one, and only one, pick without interrupting play.

BRIEF DESCRIPTION OF THE DRAWINGS

There are twenty-two relevant drawings.

DETAILED DESCRIPTION OF THE PREFERRED EMBODIMENTS

The following description represents the inventors' current preferred embodiment. The description is not meant to limit the invention, but rather to illustrate its general principles of operation. Examples are illustrated with the accompanying drawings. A variety of drawings are offered, showing the present invention with various face shapes, profiles, sizes, and slot counts.

Figure 1:
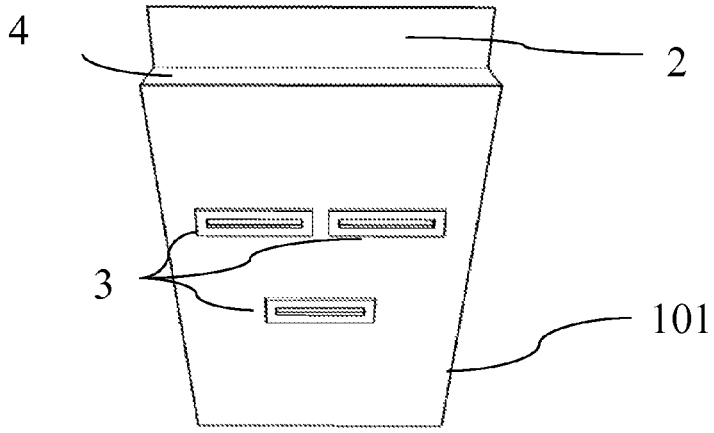
FIG. 1 is a perspective view of a thin flexible container and pick holder with a trapezoidal face.
Figure 2:
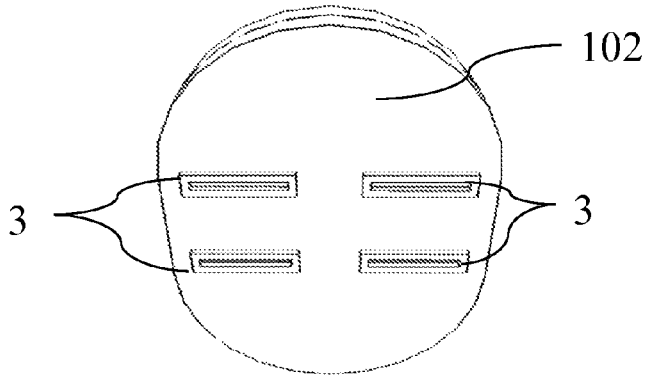
FIG. 2 is a perspective view of a flexible container and pick holder with an elongated elliptical face.
Figure 3:
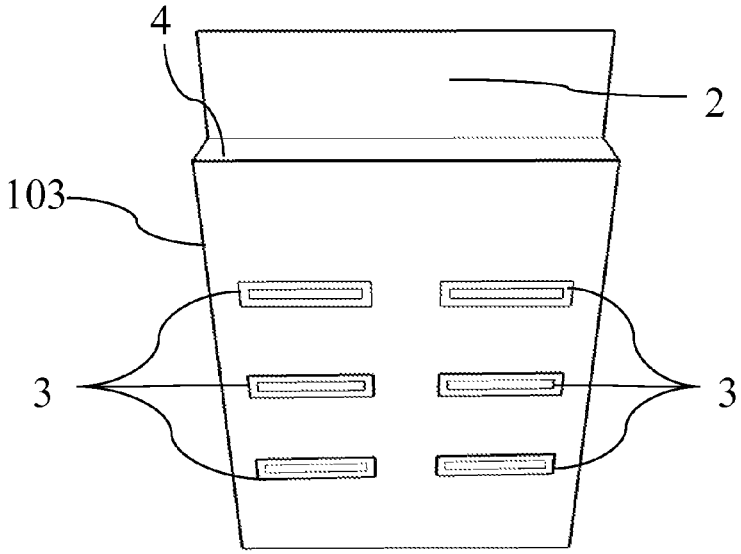
FIG. 3 is a perspective view of a flexible container and pick holder with a rectangular face.
Figure 4:
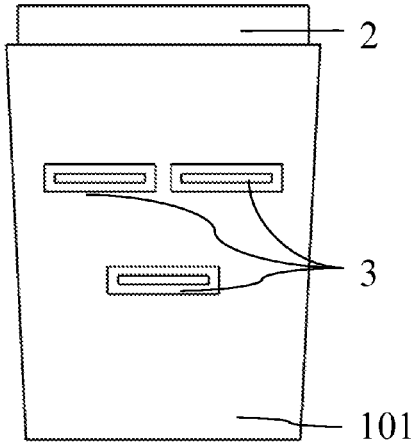
FIG. 4 is a full front view of a thin flexible container and pick holder with a trapezoidal face.
Figure 5:
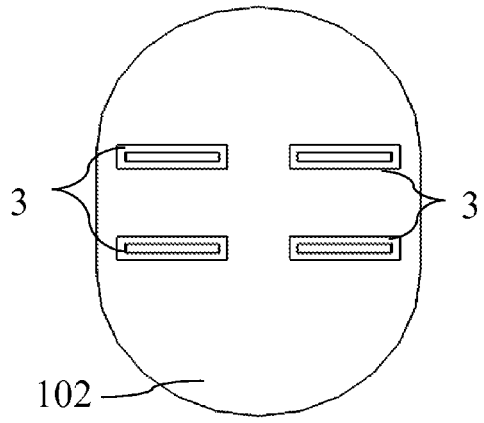
FIG. 5 is a full front view of a flexible container and pick holder with an elongated elliptical face.
Figure 6:
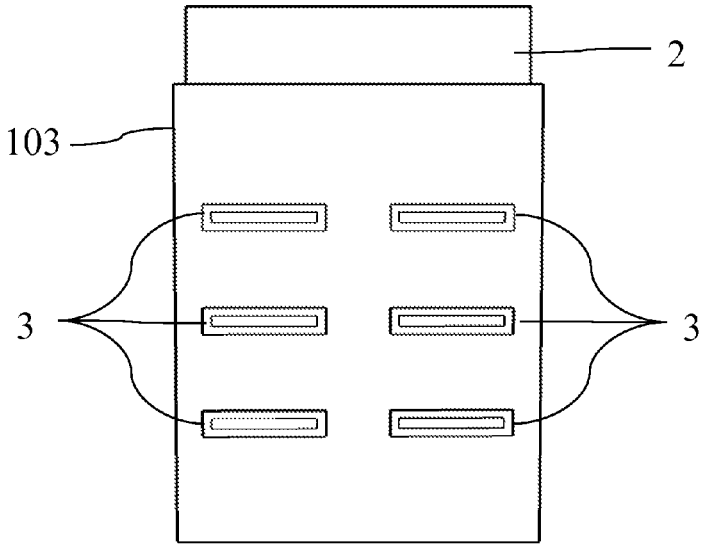
FIG. 6 is a full front view of a flexible container and pick holder with a rectangular face.

FIG. 1, FIG. 2, and FIG. 3 are perspective front views of three representations of the present invention 101, 102, 103, capable of holding guitar picks (not show in FIG. 1, FIG. 2 and FIG. 3) on the face of the flexible containers and pick holders 101, 102, 103. On the face of each flexible container and pick holder 101, 102, 103, there are a plurality of thin slots 3 for holding guitar picks. For some flexible containers and pick holders 101, 103, the inside of the container 4 is accessible by opening a flap 2.

The thin slots 3 provide ready access for a plurality of musical instrument picks. The inside 4 of the flexible containers and pick holders 101, 103 provide additional pick storage. Likewise the inside of the flexible container and pick holder 102 is accessible, although not shown in this figure. The present invention allows for a trade-off between the number of thin slots 3 holding currently available picks versus the overall size of the flexible container and pick holder 101, 102, 103.

Figure 7:
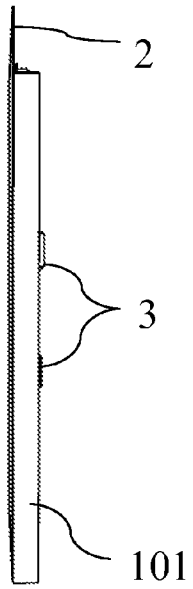
FIG. 7 is a full side view of a thin flexible container and pick holder with a trapezoidal face.
Figure 8:
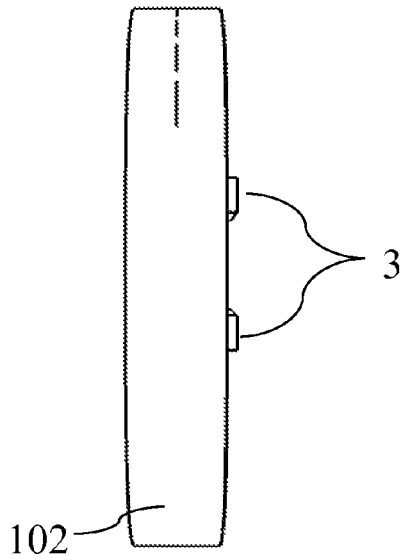
FIG. 8 is a full side view of a flexible container and pick holder with an elongated elliptical face.
Figure 9:
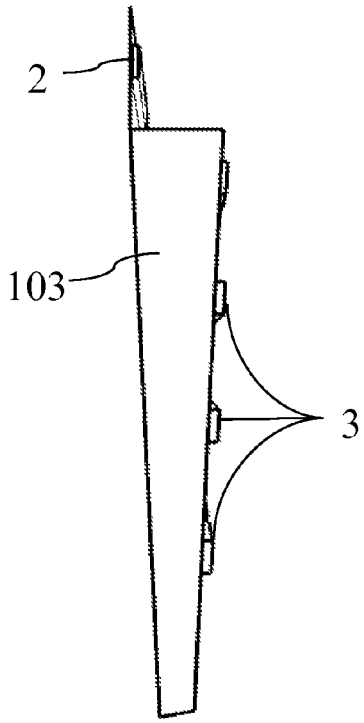
FIG. 9 is a full side view of a flexible container and pick holder with a rectangular face.
Figure 10:
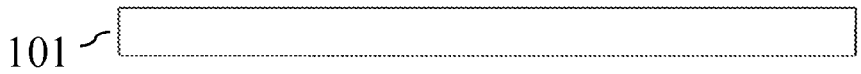
FIG. 10 is a bottom view of a thin flexible container and pick holder with a trapezoidal face.
Figure 11:
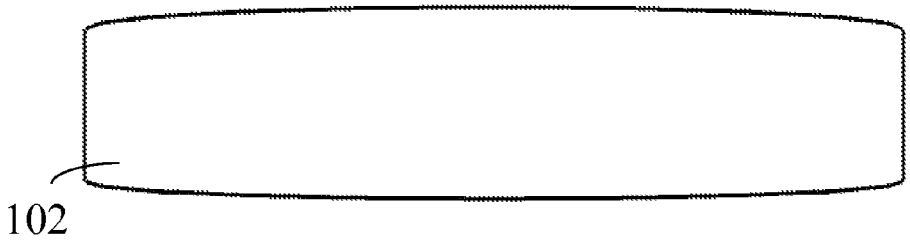
FIG. 11 is a bottom view of a flexible container and pick holder with an elongated elliptical face.
Figure 12:
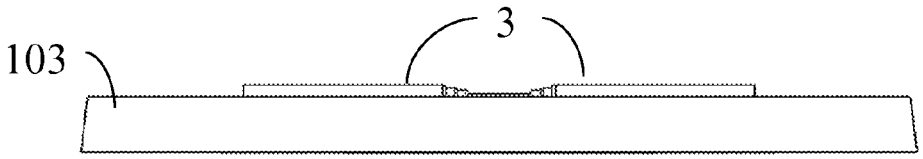
FIG. 12 is a bottom view of a flexible container and pick holder with a rectangular face.

In FIG. 7, FIG. 8, and FIG. 9, a side view of flexible containers and pick holders 101. 102, 103, are visible. Depending on the mounting location, the flexible containers and pick holders 101, 102, 103 can range from very thin 101 (FIG. 7) to relatively thick 102 (FIG. 8) to tapered 103 (FIG. 9). The available thin slots 3 for the ready access and storage of musical instrument picks is also dictated by the form factor of the flexible container and pick holder 101, 102, 103. Larger 102, 103 or smaller 101 flexible containers and pick holders may be appropriate for use by different musicians playing different instruments in different styles. The crux of the present invention is that the face of the flexible container and pick holder 101, 102, 103, can contain a plurality of thin slots 3, capable of holding a plurality of musical instrument picks or plectrums.

Figure 13:
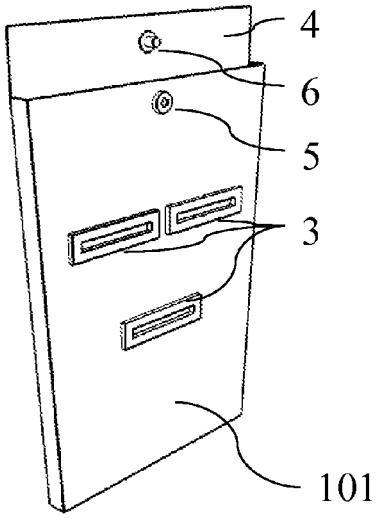
FIG. 13 is an isometric view of a thin flexible container and pick holder with a trapezoidal face.
Figure 14:
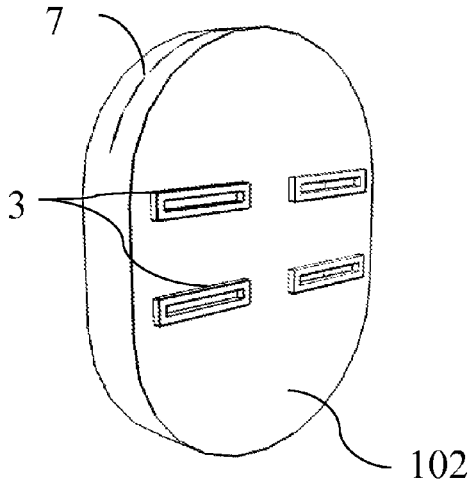
FIG. 14 is an isometric view of a flexible container and pick holder with an elongated elliptical face.
Figure 15:
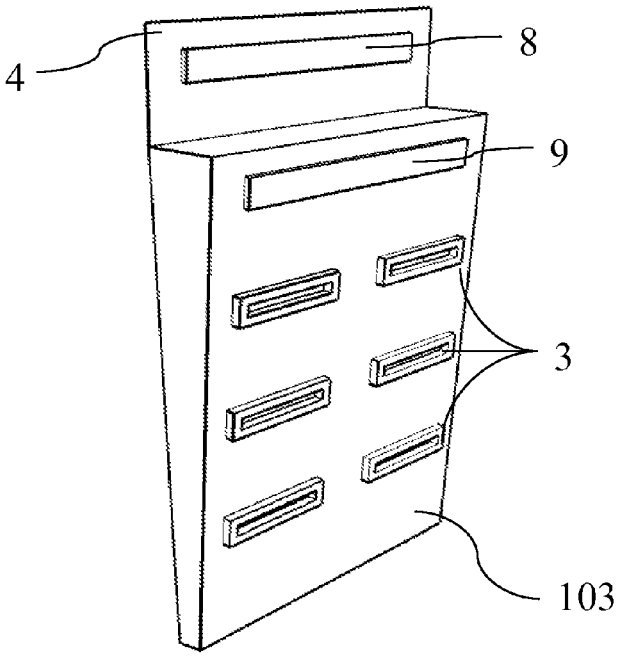
FIG. 15 is an isometric view of a flexible container and pick holder with a rectangular face.

In FIG. 13, FIG. 14, and FIG., the flexible containers and pick holders 101, 102, 103 are shown with a variety of potential closures for their interior storage 4. In FIG. 13, the flexible container and pick holder 101 has a snap 5, 6 to secure the interior 4 of the flexible container and pick holder 101. The snap is composed of a male piece 6 and a female piece 5. In FIG. 14, a flexible container and pick holder 102 is shown with a zipper 7, which controls access to the interior of the flexible container and pick holder 102. In FIG. 15, a flexible container and pick holder 103 is shown, which uses hook-and-loop 8, 9 fasteners to hold closed the flap 2 of the flexible container and pick holder 103.

Figure 16:
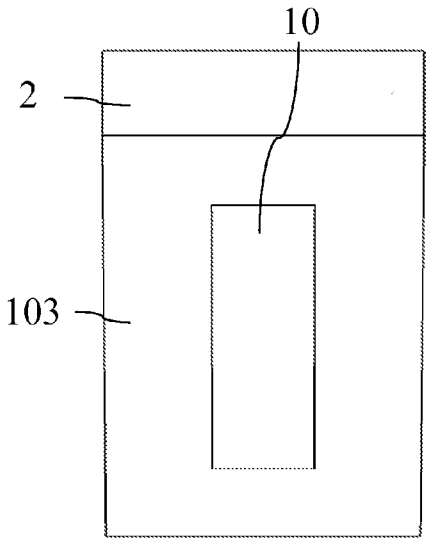
FIG. 16 is a back view of a flexible container and pick holder with a rectangular face.
Figure 17:
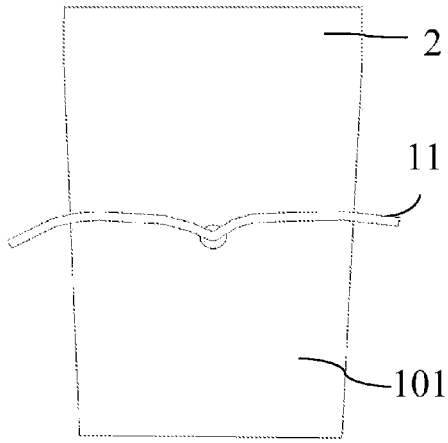
FIG. 17 is a back view of a thin flexible container and pick holder with a trapezoidal face.
Figure 18:
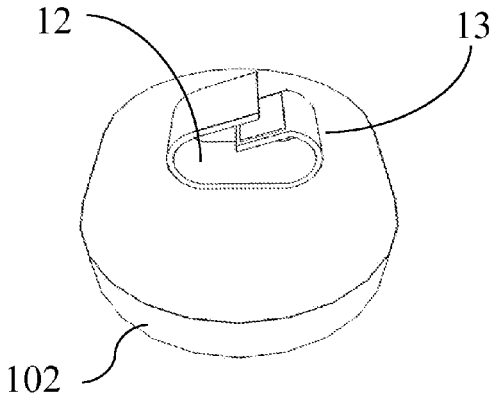
FIG. 18 is a back view of a flexible container and pick holder with an elongated elliptical face.
Figure 19:
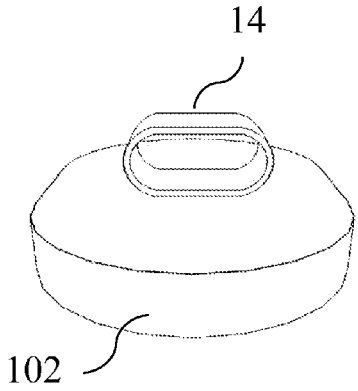
FIG. 19 is a back view of a flexible container and pick holder with an elongated elliptical face.

In FIG. 16, FIG. 17, FIG. 18, and FIG. 19, potential methods for securing the flexible container and pick holder 101, 102, 103, to the musical instrument are shown. In FIG. 16, a piece of hook-and-loop fastener is attached to the flexible container and pick holder 103. An opposing piece of hook-and-loop fastener can be attached to the musical instrument, musical instrument strap, or musician's clothing. In this fashion, the flexible container and pick holder 103 can be strategically placed to be in close proximity with the musician's strumming hand. In FIG. 17, a flexible container and pick holder is shown, which has a tiable fastener 11. This fastener 11 would allow the flexible container or pick holder 101, 102, 103 to be tied to a convenient location on the musicians strap or instrument. In FIG. 18, a fastener loop 12, 13 containing both sides of a hook-and-loop fastener 12, 13 is present. This would allow a musician to attach the flexible container or pick holder 102 to their instrument peg or instrument strap, so as to be readily available. FIG. 19 shows a flexible container and pick holder 102 with an elastic loop fastener 14. Such a fastener 14 would allow a musician to mount the flexible container and pick holder 102 on his or her strap or the musical instrument's strap peg.

Figure 20:
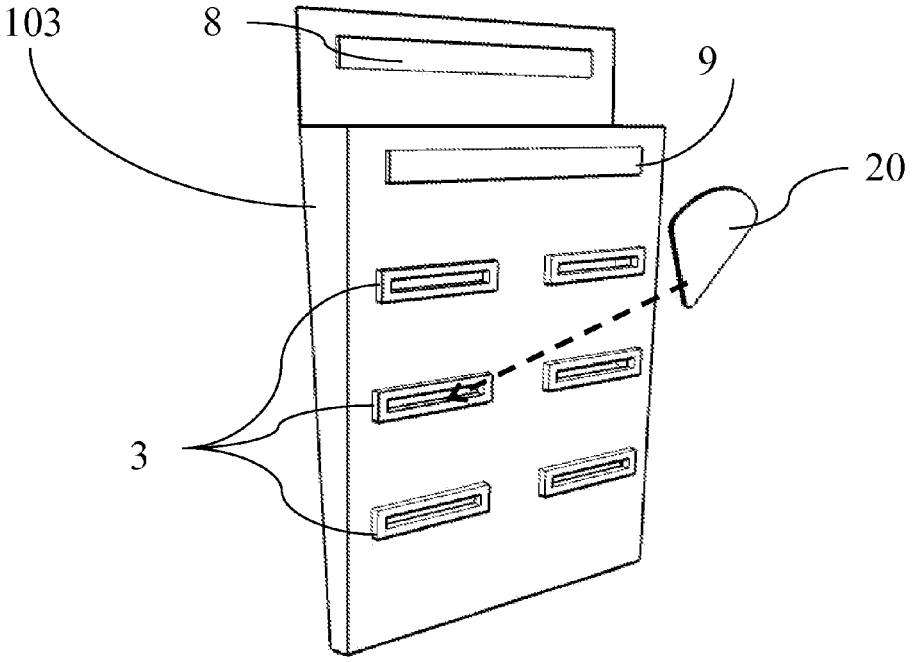
FIG. 20 is an isometric view of a flexible container and pick holder with a rectangular face, and a pick.
Figure 21:
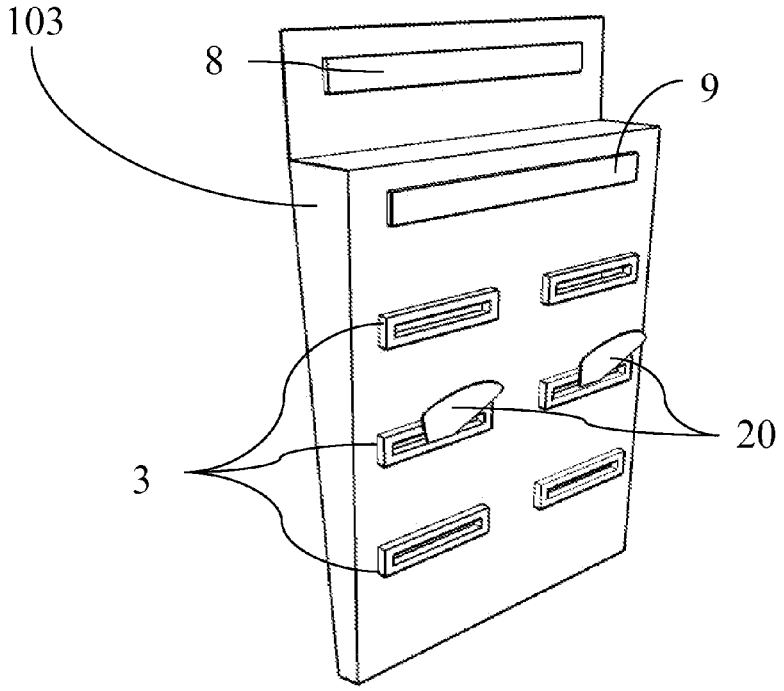
FIG. 21 is an isometric view of a flexible container and pick holder with a rectangular face with two picks inserted into face slots.

FIG. 20 shows the orientation between a flexible container and pick holder 103 and a musical instrument pick 20. The pick 20 fits into the thin slots 3 on the face of the flexible container and pick holder 103. The flap of the flexible container and pick holder 103 can be closed using the hook-and-loop fastener 8, 9. FIG. 21 shows two representative picks 20 situated in the thin slots 3 on the face of the flexible container and pick holder 103.

Figure 22:
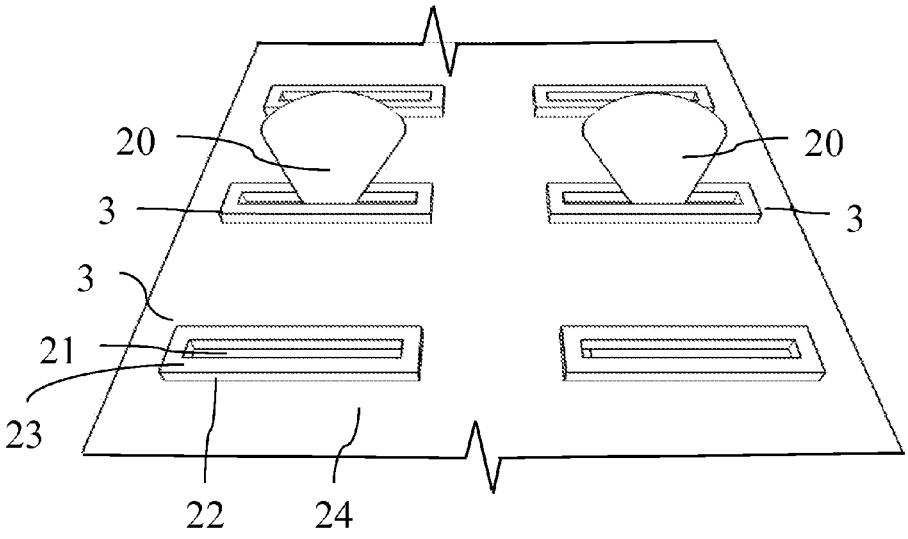
FIG. 22 is an close-up isometric view of the face slots of a flexible container and pick holder with a rectangular face.

FIG. 22 show a close up of the thin slots 3 on the face of the flexible container and pick holder 103. The thin slots 3 hold a plurality of musical instrument picks 20. The thin slot 3 is comprised of a slot 21, a top surface 23, a side surface 22, and the face 24 of the flexible container and pick holder 103. The top surface 23 and side surface 22 are sized so that a musical instrument pick 20, inserted into the face 24 of the flexible container and pick holder, will create a small, acute angle between the pick 20 and the face of the present invention 24.

The face 24 of the flexible container and pick holder 103 provides a smooth, low friction surface across which to slide the pick 20. The height of the side surface 22 and the width of the top surface 23 dictate the angle at which the pick 20 will be presented to the musician. In order to facilitate the proper retention versus friction for the pick or plectrum 20, the interior of the flexible container and pick holder 103 may be lined, if needed, with a material that creates significant retention force, including, but not limited to, rubber, elastomer, polyester, polyether, thermo-plastics, and other materials which are relatively stickier than the face 24 of the flexible container and pick holder.

I claim:

1. A flexible container and pick holder, with a defined interior created by a plurality of planar or curved segments made from a flexible material, containing at least a first face that can be disposed and oriented near a musician's strumming hand, such that a thumb of said musician's strumming hand can touch said face without reaching or extending said musician's arm; said face containing a plurality of thin slots, sized to hold musical instrument picks; said thin slots having a raised lip or ridge, which holds said picks at a small acute angle with respect to the face; said raised lips or ridges being created with plastic, embroidery, or stitched threads; said material of said face having a lower static and kinetic friction than is that typically found on said thumb of a said musician and said material being one or more of the following: leather, imitation leather, polyethylene, polypropylene, cotton, nylon, polyester, polyether, burlap, canvas, wool, satin, and silk.

* * * * *